United States Patent [19]

Hopkins

[11] Patent Number: 5,060,753

[45] Date of Patent: Oct. 29, 1991

[54] FIRE ESCAPE CHUTE

[76] Inventor: Sherlene Hopkins, 11827 Ohio, Detroit, Mich. 48204

[21] Appl. No.: 648,051

[22] Filed: Jan. 30, 1991

[51] Int. Cl.[5] ..... A62B 1/20

[52] U.S. Cl. ..... 182/48; 182/70; 193/25 B

[58] Field of Search ..... 182/48, 49, 70; 193/25 R, 25 B, 25 C

[56] References Cited

U.S. PATENT DOCUMENTS

| | | | |
|---|---|---|---|
| 3,301,347 | 1/1967 | Saita | 182/48 |
| 3,458,009 | 7/1969 | Favors | 182/48 |
| 3,580,358 | 5/1971 | Yamamoto | 182/48 |
| 3,838,750 | 10/1974 | Williams, Jr. | 182/48 |
| 3,910,532 | 10/1975 | Fisher | 244/137 |
| 4,005,762 | 2/1977 | Fephinie | 182/48 |
| 4,162,717 | 7/1979 | Orii | 182/48 |
| 4,398,621 | 8/1983 | Baker | 182/48 |
| 4,582,166 | 4/1986 | Baker | 182/48 |

FOREIGN PATENT DOCUMENTS

| | | | |
|---|---|---|---|
| 2100886 | 1/1971 | Fed. Rep. of Germany | 182/48 |
| 5218100 | 2/1977 | Japan | 182/48 |
| 2152887 | 1/1984 | United Kingdom | 182/48 |

*Primary Examiner*—Reinaldo P. Machado
*Attorney, Agent, or Firm*—Dykema Gossett

[57] ABSTRACT

A fire escape chute for a home includes a housing secured to a building wall below a window having a first chamber for a compressed air tank having an outlet with a normally closed release valve and a second storage chamber. A yieldable chute support pan forms the bottom of the second chamber and is pivotally mounted upon the housing and retained in a horizontal position. A hollow double wall open ended collapsible chute is stacked within the second chamber upon the pan. A normally closed cover is pivotally mounted upon the housing and supportably retains the pan. A retracted expansion device within the second chamber is connected to the cover and when manually released tilts the cover to an upright position retainingly engaged by a latch. An air plenum on the cover having a plurality of outlets is connected to the air release valve. One end of the chute encloses and is secured to the plenum and communicates with its outlets. The cover outwardly opens upon release of the expansion device, triggers the air supply to the plenum and chute, the pan drops and the chute drops from its housing to instantly inflate.

9 Claims, 2 Drawing Sheets

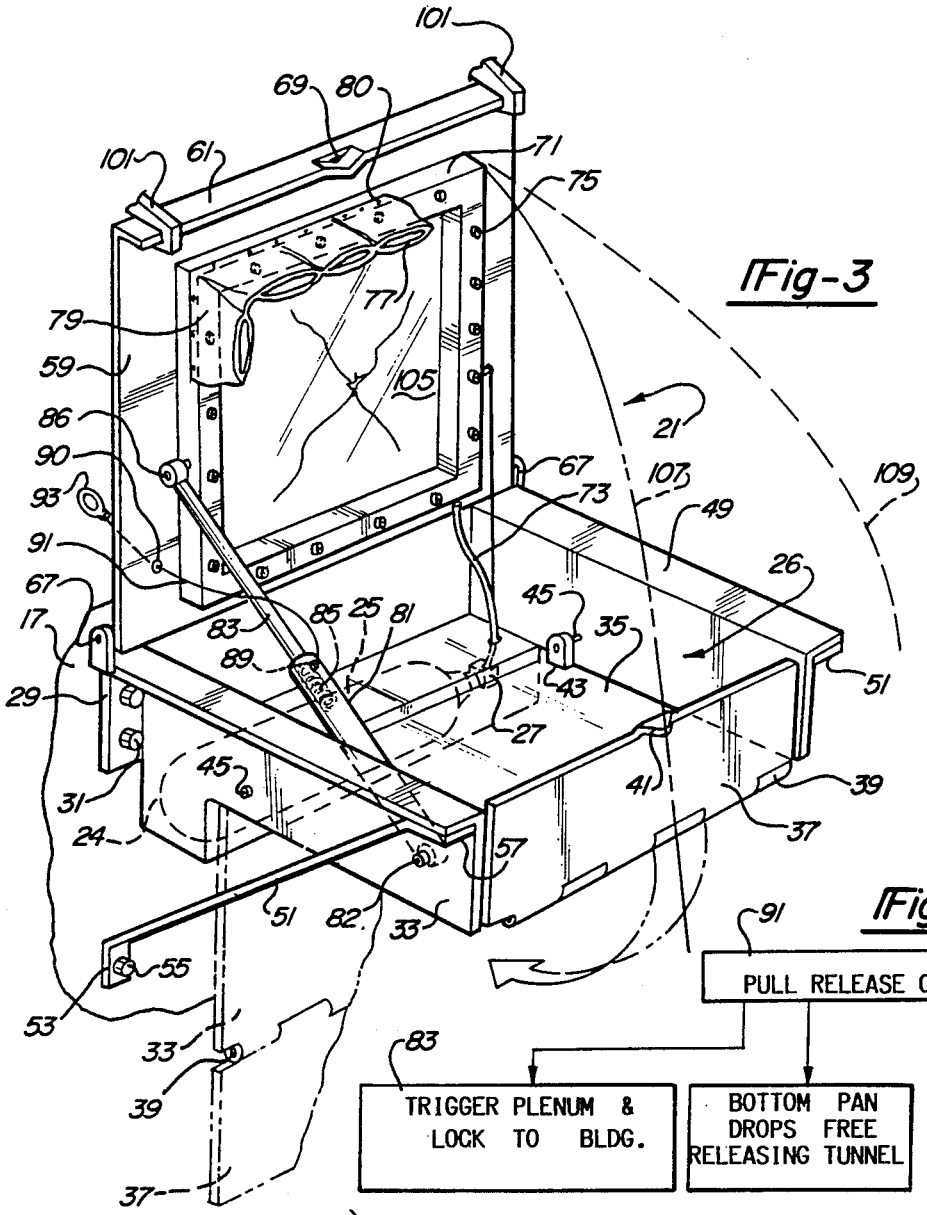
Fig-3
Fig-4
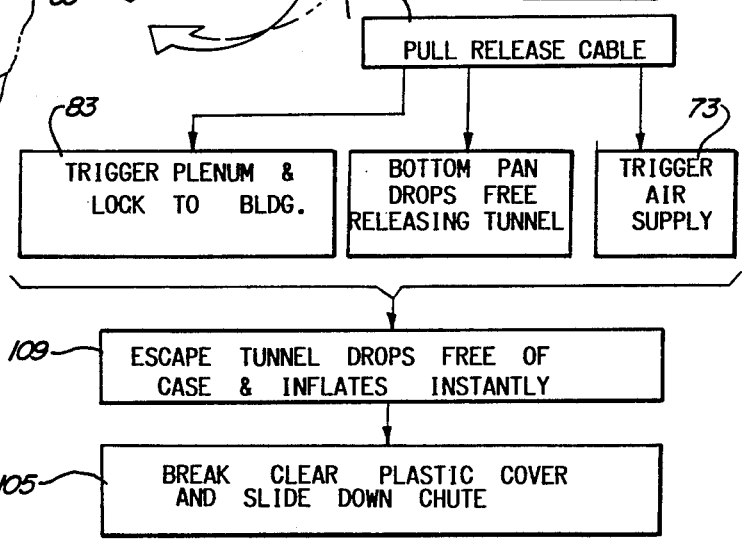

FIRE ESCAPE CHUTE

FIELD OF THE INVENTION

The present invention relates to fire escape chutes and more particularly to a fire escape chute for a home with a stacked chute stored within a housing adjacent a window and a tank of pressurized air to expand the chute suspended at one end from the building.

BACKGROUND OF THE INVENTION

Previously, there has been the problem of escaping from buildings on fire from wherein efforts have been made to provide an inflatable chute.

Earlier efforts to accomplish this result are shown in one or more of the following patents:

| Patent No. | Date | Title |
|---|---|---|
| 3,458,009 | 07/29/69 | Evacuation Slide |
| 3,580,358 | 05/25/71 | Safety Escape Bag |
| 3,838,750 | 10/01/74 | Fire Escape Apparatus |
| 3,910,532 | 10/07/75 | Inflatable Deployment System and Method |
| 4,582,166 | 04/15/86 | Fire Escape Having Guide Wire Mechanism |

Foreign Patents
Germany 2 100 886; Jan. 9, 1971
Japan 5218100; 2,10,1977; Inventor: Kenkyusho
United Kingdom 2 152 887 A; Jan. 18, 1984; Inventor: Rennison

SUMMARY OF THE INVENTION

An important feature of the present invention is to provide an inflatable fire escape chute for a home or other building wherein a covered housing is mounted upon a building wall below a second floor window and wherein one end of the collapsible chute is securely anchored to the building adapted for communication to a source of pressurized air and wherein the chute when activated will drop from the housing and extend to the ground surface.

Another feature is to provide a housing secured to a building wall below a window having first and second chambers with a compressed air tank stored within the first chamber and with the second chamber provided with a yieldable support pan providing the bottom of the said chamber at one end pivotally mounted upon the housing and retained in a horizontal position by the chamber cover.

As another feature, the housing includes a normally closed cover at one end pivoted upon the housing enclosing the tank. A stacked chute is stored within the second chamber together with a manually releasable expansion means connected to the cover for pivoting the cover to an upright position in registry with a window.

As a further feature, a pair of latches are mounted upon the building wall on opposite sides of the window whereby when the cover has been pivoted to an upright position it is interlocked with the latches and retained against the building wall in an upright position.

As another feature, there is provided upon the pivotal cover a hollow rectangular plenum having a series of air outlets and wherein one end of a double walled collapsed chute normally stored within the second chamber of the housing is secured over the plenum and in communication with its outlets.

As another feature, there is stored within the housing retracted expansion means such as a spring biased piston rod connected to the cover adapted when released for pivoting the cover to an upright position. Such movement establishes communication between the compressed air in a tank and the plenum and wherein the upward pivotal movement of the cover permits the pivotal pan of the housing to drop down. At the same time the free end portions of the stacked chute fall towards the ground surface and for immediate expansion through the supply of compressed air through the plenum outlets to the hollow walls of the chute.

As a further feature, the cover for the housing as a central opening therein corresponding to the central opening of the plenum which is normally covered by a clear plastic breakable cover normally protectively enclosing the contents of the housing but in the use position permits user access to the chute.

These and other objects and features will be seen from the following specification and claims in conjunction with the appended drawings.

THE DRAWINGS

FIG. 3 is a front perspective view similar to FIG. 2 but with the cover opened and clamped and with portions of the chute broken away for illustration.

FIG. 4 is a schematic diagram of the steps involved in utilizing the present fire escape chute assembly.

It will be understood that the above drawings illustrate a preferred embodiment of the invention, and that other embodiments are contemplated within the scope of the claims hereafter set forth.

DETAILED DESCRIPTION OF AN EMBODIMENT OF THE INVENTION

Figure 1:
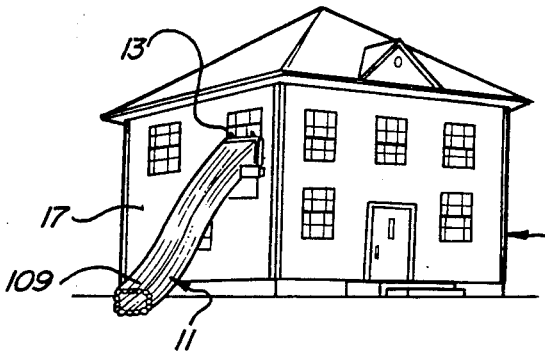
FIG. 1 is a perspective view of a building with the present fire escape chute deployed in a use position.
Figure 2:
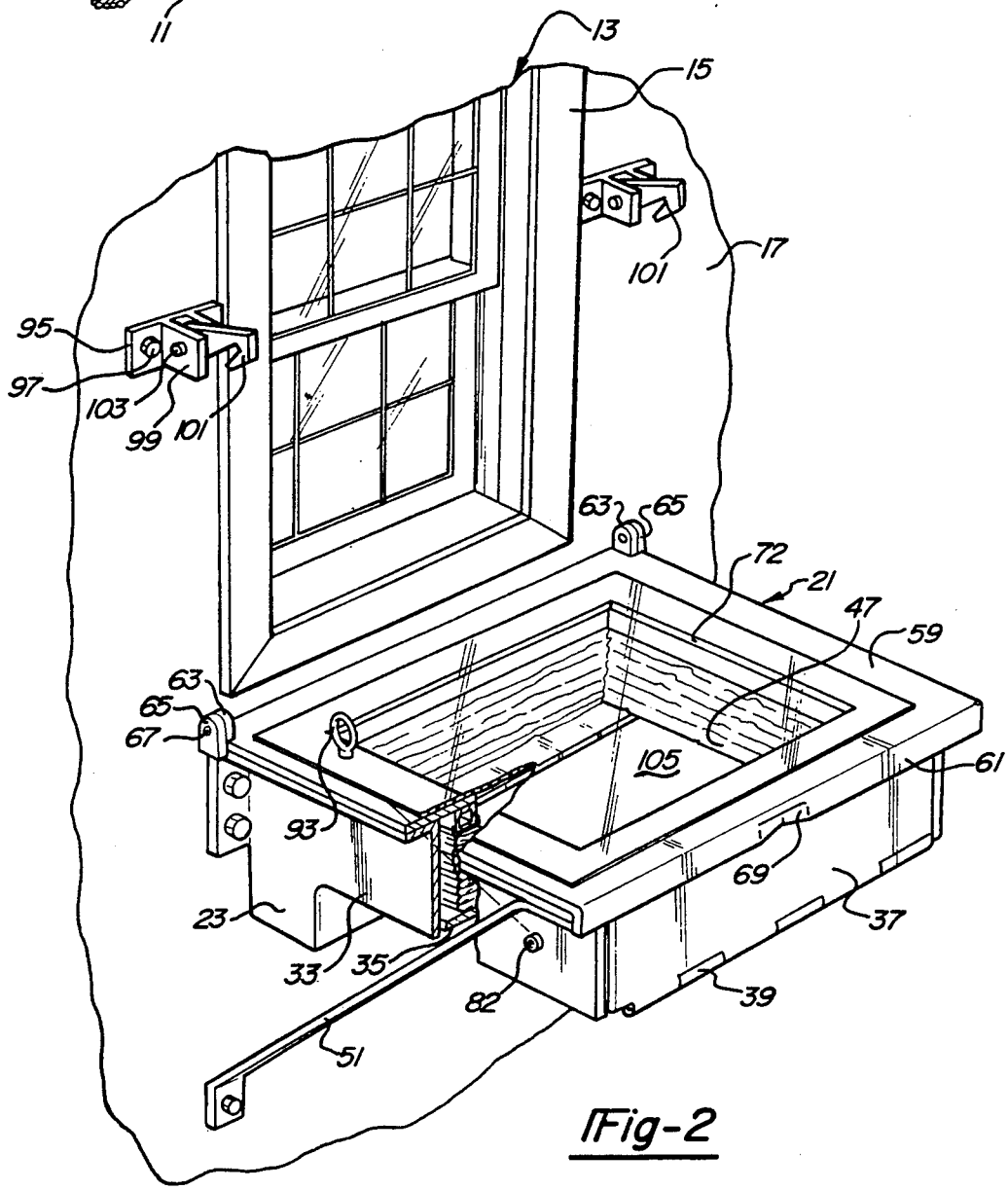
FIG. 2, is a front perspective view of a portion of the building wall and window with the present fire escape chute assembly secured thereto in a normal non-use position, partly broken away and sectioned.

Referring to the drawings, FIGS. 1–4, the present inflatable fire escape chute assembly is generally indicated at 11, FIG. 1, for use in conjunction with a second floor window 13 having a conventional frame 15 fragmentarily shown in FIG. 2, upon building wall 17 for the house 19.

The present safety chute assembly 21 is more particularly defined in FIGS. 2 and 3 as including a housing 23 having first and second chambers 24 and 26, FIG. 3. A conventional compressed air tank 25 is stored and supported within the first chamber 24, and includes an outlet with a normally closed release valve 27.

Mount flanges 29 at opposite ends of housing 23 bear against building wall 17 and are secured thereto by fasteners 31. Said housing includes a pair of laterally spaced forwardly extending side walls 33. The normally horizontal chute support pan 35 provides the bottom for the second chamber 26 and includes a transverse elongated end flap 37 defining the protective end wall for chamber 26 of said housing. Flap 37 is connected to pan 35 by the transverse hinge 39. The upper edge of said flap terminates in the out-turned tang 41. The opposite inner end of pan 35 includes a pair of yokes 43 which receive the opposed pair of pivot pins 45 which extend through side walls 33. This provides a pivot mounting for pan 35. The present double wall chute constructed of a strong flexible material such as canvas or plastic or the like, is shown vertically stacked at 47 upon pan 35, FIG. 2. The respective side walls 33 at their upper edges terminate in the side flanges 49.

A pair of laterally spaced upwardly inclined reinforcing bars 51 at their one ends 53 are secured by fasteners 55 to wall 17. The upper ends of the reinforcing bars as at 57 are secured to undersurface portions of side flanges 49 in any suitable manner such as by fasteners similar to the fasteners 55 or by welding.

Housing 23 has a cover 59 which normally overlies housing 23. Cover 59 adjacent its rear edge includes a pair of apertured yokes 63. These bear against a corresponding spaced pair of housing yokes 65 and are pivotally interconnected by the transverse pivot pins 67, FIG. 2.

Cover 59 includes at its outer edge a downturned anchor flange 61. Intermediate its edges is a recessed detent 69 adapted for corresponding retaining registry with the end flap tang 41 of the housing shown in FIG. 4. This provides a means so that when the cover 59 is in a closed position, it interlocks with tang 41 of the flap 37 thereby holding pan 35 in the storage horizontal position, FIG. 3.

The hollow rectangular pressure air plenum 71 is secured upon the underside of cover 59 centrally thereof and is in registry with the corresponding cover opening 72, FIG. 2. Flexible air hose 73 at one end is connected to the tank outlet having a normally closed valve 27 and at its opposite end is connected to plenum 71.

The connection of hose 73 to the outlet and valve 27 is such that when the cover has been automatically opened to the upright position shown in FIG. 3, the valve 27 is automatically opened to permit the passage of pressurized air from the compressed air tank 25 to the interior of plenum 71.

Said plenum has a series of longitudinally spaced outlet nozzles 75 on and around its inner surface, FIG. 3. The present double walled chute 11 of a flexible, strong material such as canvas or plastic or the like is generally of rectangular shape in cross section and has a plurality of right angularly related walls forming a part of the chute, FIG. 1. Each of the respective walls of the chute include a series of independently arranged side by side chute tubes 77. Each of these tubes at their one ends overlie and is in communication with the corresponding respective outlets 75 of the plenum for transmission of pressurized air thereinto.

The respective corresponding tube ends terminate in the unit tube connector 79 which bears against and surrounds plenum 71 and is suitably secured to said plenum and anchored thereto as by suitable fasteners 80 or other securing means.

Opposite ends of the respective chute tubes 77 are closed and interconnected to form the respective corresponding side walls of the completed chute as deployed in FIG. 1.

In the illustrative embodiment and as the expansion means employed for automatically opening the cover 59 to the position shown in FIG. 3, there is employed a cylinder 81, positioned within housing chamber 26 and at one end pivotally connected thereto at 81. There is provided within said cylinder a piston and piston rod 83 normally spring biased forwardly by an enclosed coiled spring 85 which in the retracted position would be under compression as in FIG. 2.

The piston rod 83 and its integral piston bears against the compression spring 85, is normally retracted, and as shown in FIG. 3 has been extended outwardly of the cylinder and is pivotally connected at 86 to an intermediate side wall portion of plenum 71. This provides the pivotal connection of the piston rod 83 to cover 59 to which the plenum is connected.

A suitable latch detent 87 is provided within the outer end of the cylinder 81 normally retaining the piston rod in a retracted position. Release cable 91 is connected to latch detent 87, FIG. 3, extends through cover aperture 90 and terminates in the pull ring 93 available for use to the user when the window shown in FIG. 2 has been elevated. A slight pull upon the ring 93 extends the cable 91 releasing the detent 87 and permits the piston rod 83 under the action of the compression spring 85, or other pressure means to so expand as to pivot the cover to the upright position shown in FIG. 3.

A pair of laterally spaced latch plates 95 are secured to the building wall on opposite sides of the frame 15 as by fasteners 95, FIG. 2. Each latch plate includes a yoke 99 within which is mounted a latch 101 pivoted at 103 and including a spring bias downwardly so as to snap interlock with the cover flange 61 when the cover has been pivoted to the upright position shown in FIG. 3.

The pair of latches 101 fragmentarily shown in FIG. 3, provide a means of effectively anchoring the cover 59 in the upright position shown against the wall 17. This provides a means by which the free upper end of the chute 11 as connected to the plenum 71 is anchored to the building wall 17 adjacent a portion of the window 13 for use as desired in an emergency.

Formed through the cover 59 is a corresponding aperture 72 matching the opening of the plenum 71 over which is extended and secured a clear plastic frangible cover 105. Normally the cover protectively encloses the contents of the housing 23 until it is ready for use.

When the cover has been swung to the upright position shown FIG. 3, it disengages from the tang 41 on the flap 37 so that the pan 35 drops by gravity to the dash line position shown in FIG. 3 with the end flap depending therefrom.

At the same time, the chute 107 drops down by gravity as designated by dash lines at 107 and is immediately inflated as designated at dash lines 109, FIG. 3, to the use position, FIG. 1. FIG. 4 shows a schematic diagram of the respective steps of operation.

In FIG. 4, the pull release cable 91 is tensioned by pulling the ring 93, FIG. 2. This first releases the detent 87 causing the cover 59 to tilt to the upright position shown in FIG. 3. It automatically latches at 101. At the same time, the cover flange 61 becomes disengaged from the end flap 37 so that pan 35 and flap 37 drop to the dash line position, FIG. 3. At the same time, the pivotal upward movement of the cover 59 triggers the air supply through the tube 73 to the plenum 71.

As further shown in the diagram, FIG. 4, escape tunnel chute 11 drops free of the housing 23 first to the deflated general position at 107, FIG. 3, with almost immediate inflation to the dash line position 109 and also shown deployed in FIG. 1.

At that time, the extended chute is ready for use. User, with the corresponding lower window already elevated for access to the ring 93, merely breaks the frangible plastic 105 and enters the chute through the cover aperture 72 and through the plenum 71 for sliding down the interior of the chute to the ground surface, FIG. 1.

Having described my invention, reference should now be had to the following claims.

I claim:

1. A fire escape chute for a home comprising a housing secured to a building wall below a window and having first and second storage chambers;

a compressed air tank having an outlet with a normally closed release valve stored within said first chamber;

a chute support pan forming the bottom of said second chamber, pivotally mounted upon said housing and retained in a horizontal position;

a hollow double wall open ended collapsibly folded chute stacked within said second chamber upon said pan;

a normally closed apertured cover pivotally mounted upon said housing enclosing said tank and chute and supporting said pan;

retracted expansion means within said housing connected to said cover, when manually released, pivoting said cover to an upright position in registry with said window;

yieldable clamp means upon said wall for anchoring said cover in an upright position;

a hollow rectangular air plenum having a plurality of spaced outlets secured upon said cover and connected to said outlet; and a connector on one end of said chute surrounding and fixedly secured to and sealed over said plenum and its outlets for receiving compressed air between the double walls of said chute for inflating and extending said chute along its length;

said cover opening upon manual release of said expansion means for interlock with said clamp means, said cover movement opening said valve pressurizing said plenum, releasing said chute support pan, said chute dropping from said housing for immediate inflation and extension and at its lower end engagable with the ground surface.

2. In the fire escape of claim 1, further comprising said expansion means including a cylinder at one end pivotally mounted within said housing and a retracted spring biased piston rod movably projecting from said cylinder and at one end pivotally connected to said cover.

3. In the fire escape of claim 2, further comprising a releasable detent normally holding said piston rod in retracted position; and a cable extending from said detent, through said cylinder and through said cover and terminating in a pull ring, actuating said pull ring, retracting said detent.

4. In the fire escape of claim 1, further comprising said clamp means including a pair of depending spring biased pivotal latches mounted upon said wall; and said cover when in an upright position interlocking with said latches.

5. In the fire escape of claim 4, further comprising said cover having a depending anchor flange interlocked with said latches.

6. In the fire escape of claim 5, further comprising said anchor flange including a recessed detent;

an upright end flap pivotally mounted upon one end of said pan, normally closing said housing and having a tang interlocked with said recessed detent;

pivotal movement of said cover disengaging said detent and tang; and said flap and pan falling by gravity to release said chute.

7. In the fire escape chute of claim 1, further comprising a pair of laterally spaced outwardly and upwardly inclined reinforcing bars at their one ends secured to said wall and at their outer ends secured to said housing.

8. In the fire escape chute of claim 1, further comprising said chute including a plurality of right angularly related walls defining an elongated tube of rectangular cross section;

each wall including a plurality of chute tubes arranged side by side, at their one ends extending to said plenum and communicating with its outlets respectively; and the other ends of said tubes being closed.

9. In the fire escape chute of claim 1, further comprising said cover having a rectangular opening therethrough matching the opening in said plenum; and a frangible clear plastic cover mounted over said cover opening, said plastic cover being hand fractured facilitating passage of a user through said cover and plenum and into said chute.

* * * * *